United States Patent [19]

Satake et al.

[11] Patent Number: 5,050,808

[45] Date of Patent: Sep. 24, 1991

[54] MILLING APPARATUS AND SYSTEM THEREFOR

[75] Inventors: Toshihiko Satake, Hiroshima; Satoru Satake, Tokyo; Yukio Hosaka, Hiroshima, all of Japan

[73] Assignee: Satake Engineering Co., Ltd., Tokyo, Japan

[21] Appl. No.: 452,271

[22] Filed: Dec. 18, 1989

[51] Int. Cl.[5] ..... B02C 23/00

[52] U.S. Cl. ..... 241/37; 241/79.1; 241/101.3; 241/159; 241/231

[58] Field of Search ..... 241/101.4, 101.3, 37, 241/78, 77, 79.1, 159, 230, 231

[56] References Cited

U.S. PATENT DOCUMENTS

| | | | |
|---|---|---|---|
| 2,879,004 | 3/1959 | Dodds et al. | 241/77 X |
| 2,984,423 | 5/1961 | Roth | 241/231 X |
| 3,493,183 | 2/1970 | Fischer et al. | 241/78 X |
| 3,944,146 | 3/1976 | Stockmann et al. | 241/101.3 X |
| 4,133,899 | 1/1979 | Wolffing et al. | 241/235 X |
| 4,338,024 | 7/1982 | Bolz et al. . | |
| 4,363,448 | 12/1982 | Mächler et al. | 241/37 X |
| 4,682,737 | 7/1987 | Ono | 241/101.3 X |
| 4,746,070 | 5/1988 | Kuster | 241/37 |
| 4,817,441 | 4/1989 | Porowski et al. | 241/101.3 X |
| 4,881,689 | 11/1989 | Lippuner et al. | 241/37 X |

*Primary Examiner*—Mark Rosenbaum
*Assistant Examiner*—Frances Chin
*Attorney, Agent, or Firm*—Wegner, Cantor, Mueller & Player

[57] ABSTRACT

In a milling apparatus for milling granular material into milled particles, a roll mill includes a pair of rolls which are rotatably arranged in facing relation to each other. At least one of the rolls is movable toward and away from the other. A gap adjusting unit is associated with the at least one roll for moving the same toward and away from the other roll to adjust a gap between the rolls thereby adjusting a milling degree of the milled particles. A measuring unit is arranged downstream of the roll mill and is connected to the gap adjusting unit thereof for measuring the milling degree of the milled particles. The gap adjusting unit is operative in response to an output signal from the measuring unit to move the at least one roll toward and away from the other roll, thereby automatically adjusting the milling degree of the milled particles. A milling system is provided which includes at least two roll mills described above.

20 Claims, 5 Drawing Sheets

MILLING APPARATUS AND SYSTEM THEREFOR

BACKGROUND OF THE INVENTION

The present invention relates to an apparatus for milling or flouring granular material such as wheat or the like, and to a system comprising a plurality of milling apparatus each of which includes a roll mill.

In milling operation by which granular material to be milled such as wheat or the like is milled to flour, the granular material is supplied to a roll mill where the granular material is milled. However, the granular material is not milled to powder at a time. Specifically, a plurality of roll mills are arranged in series, and are functionally combined with a plurality of sorting units and a plurality of transporting units to obtain milled material of the wheat or the like such as flour, that is, to obtain a product which is milled to a requisite particulate or milling degree.

Special attention is required to be paid to adjustment of the milling degree of the milled material at each of the roll mills, arrangement of screens or sieves of each of the sorting units such as sieve sorters, and so on, in order to efficiently operate the plurality of roll mills and sorting units to produce the milled material of high quality. In each of the roll mills, a spacing or a gap between a pair of rolls is particularly a primary factor which affects the milling degree. Considerable time is required for adjustment of the gap. Further, differences in various characters such as a particulate or grain size of the granular material to be supplied, moisture content of the granular material, and so on, are revealed as a difference in the milling degree. Even in the course of the operation, the milling degree changes so that inspection and adjustment of the gap between the pair of rolls are required.

Moreover, there is a measuring device for judging the milling degree, in which, after sieve sorting, the milling degree is judged on the basis of comparison in weight of the sorted milled particles. However, because of sorting of the powder, the necessity remains in which attention is paid to selection of the sieves, their arrangement and so on.

SUMMARY OF THE INVENTION

It is an object of the invention to provide milling apparatus which judges a milling degree of milled material to automatically adjust a gap between a pair of rolls of a roll mill which affects the milling degree, thereby being capable of always producing the milled material of high quality.

It is another object of the invention to provide a milling system comprising at least two mills connected in series relation to each other.

According to the invention, there is provided an apparatus for milling granular material, comprising:

a roll mill for milling the granular material into milled particles, the roll mill including a pair of rolls which are rotatably arranged in facing relation to each other, at least one of the pair of rolls being movable toward and away from the other, and gap adjusting means associated with the at least one roll for moving the same toward and away from the other roll to adjust a gap between the pair of rolls thereby adjusting a milling degree of the milled particles; and measuring means arranged downstream of the roll mill and connected to the gap adjusting means thereof for measuring the milling degree of the milled particles to issue an output signal representative of the milling degree, wherein the gap adjusting means is operative in response to the output signal from the measuring means to move the at least one roll toward and away from the other roll, thereby automatically adjusting the milling degree of the milled particles.

According to the milling apparatus of the invention, the measuring means for measuring the milling degree of the milled material is associated with the roll mill, and the at least one roll is moved toward and away from the other roll on the basis of the output signal from the output signal from the measuring means such that the gap between the pair of rolls is adjusted. Thus, it is possible to always maintain a predetermined milling degree stably, regardless of a difference in various characters of the granular material.

According to the invention, there is further provided a system for milling granular material, comprising:

at least two, first and second roll mills for milling the granular material into milled particles, each of the first and second roll mills including a pair of rolls which are rotatably arranged in facing relation to each other, at least one of the pair of rolls being movable toward and away from the other, and gap adjusting means associated with the at least one roll for moving the same toward and away from the other roll to adjust a gap between the pair of rolls thereby adjusting a milling degree of the milled particles;

at least one measuring means arranged downstream of the first and second roll mills and connected to the gap adjusting means thereof for measuring the milling degree of the milled particles sent from the respective first and second roll mills, to issue output signals representative of the respective milling degrees, wherein the gap adjusting means of each of the first and second roll mills is operative in response to a corresponding one of the output signals from the measuring means to move the at least one roll toward and away from the other roll, thereby automatically adjusting a corresponding one of the milling degrees of the milled particles.

Since the granular material is milled with the milling degrees determined in a stepwise manner, more accurate control or management is required for each roll mill. According to the milling system of the invention, however, it is easy to operate the first and second roll mills adequately. Thus, it is possible to always produce the milled material of high quality efficiently.

DETAILED DESCRIPTION

The invention will now be described, by way of mere example, with reference to the accompanying drawings.

Figure 1:
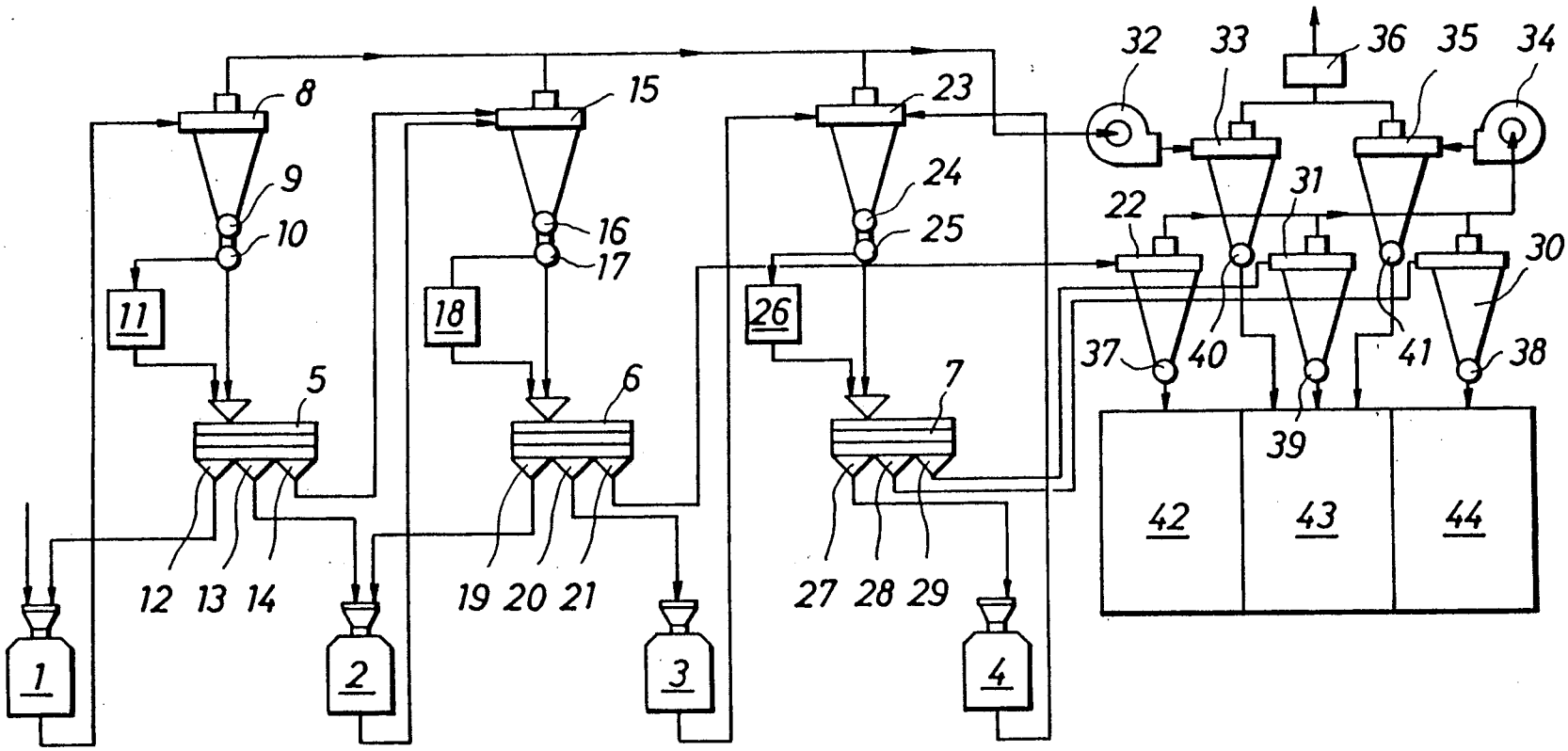
FIG. 1 is a schematic view showing the entire arrangement of a milling system according to an embodiment of the invention.

Referring first to FIG. 1, there is shown the entire arrangement of a milling system according to an embodiment of the invention. The milling system comprises main components which include four roll mills or flour mills 1, 2, 3 and 4 connected in series relation to each other and three sieve sorters 5, 6 and 7. In other words, the milling system comprises three sets of milling apparatuses and the fourth roll mill 4. Each of the milling apparatuses includes the roll mill 1, 2 or 3 and a measuring device 11, 18 or 26. It is needless to say that the milling system may comprise a pair of roll mills and a pair of sieve sorters.

The first roll mill 1 communicates with a cyclone 8, by means of pneumatic transportation. The cyclone 8 has, at its bottom, an air-lock valve 9. A directional control valve 10 arranged downstream of the air-lock valve 9 communicates with the measuring device 11 for measuring a milling degree of milled material such that a part of milled particles is supplied to the measuring device 11. The measuring device 11 communicates with a supply port of the first sieve sorter 5. The directional control valve 10 also communicates directly with the sieve sorter 5.

In the illustrated embodiment, the sieve sorter 5 can sort and separate the milled particles in three stages dependent upon particle size of the milled particles. Specifically, the sieve sorter 5 has a large-particle discharge port 12, an intermediate-particle discharge port 13 and a small-particle discharge port 14. The large-particle discharge port 12, the intermediate-particle discharge port 13 and the small-particle discharge port 13 communicate respectively with a supply port of the first roll mill 1, a supply port of the second roll mill 2 and a cyclone 15.

The second roll mill 2 communicates with the cyclone 15, by means of pneumatic transportation. The cyclone 15 has, at its bottom, an air-lock valve 16. A directional control valve 17 arranged downstream of the air-lock valve 16 communicates with the measuring device 18 for measuring a milling degree of the milled material such that a part of the milled particles is suitably supplied to the measuring device 18. The measuring device 18 communicates with a supply port of the second sieve sorter 6. The directional control valve 17 also communicates directly with the sieve sorter 6.

The sieve sorter 6 can sort and separate the milled particles in three stages dependent upon particle size of the milled particles. Specifically, the sieve sorter 6 has a large-particle discharge port 19, an intermediate-particle discharge port 20 and a small-particle discharge port 21. The large-particle discharge port 19, the intermediate-particle discharge port 20 and the small-particle discharge port 21 communicate respectively with the supply port of the second roll mill 2, a supply port of the third roll mill 3 and a cyclone 22.

The third roll mill 3 communicates with a cyclone 23, by means of pneumatic transportation. The cyclone 23 has, its bottom, an air-lock valve 24. A directional control valve 25 arranged downstream of the air-lock valve 24 communicates with the measuring device 26 for measuring a milling degree of the milled material such that a part of the milled particles is suitably supplied to the measuring device 26. The measuring device 26 communicates with a supply port of the third sieve sorter 7. The directional control valve 25 also communicates directly with the third sieve sorter 7.

The third sieve sorter 7 can sort and separate the milled particles in three stages dependent upon particle size of the milling particles. Specifically, the third sieve sorter 7 has a large-particle discharge port 27, an intermediate-particle discharge port 28 and a small-particle discharge port 29. The large-particle discharge port 27, the intermediate-particle discharge port 28 and the small-particle discharge port 29 communicate respectively with a supply port of the fourth roll mill 4, a cyclone 30 and a cyclone 31. The fourth roll mill 4 communicates with the cyclone 23, by means of pneumatic transportation.

The cyclones 8, 15 and 23 communicate with a cyclone 33 through a blower 32 such that exhaust air from the cyclones 8, 15 and 23 is supplied to the cyclone 33. The cyclones 22, 31 and 30 also communicate with a cyclone 35 through a blower 34 such that exhaust air from the cyclones 22, 31 and 30 is supplied to the cyclone 35. The cyclones 33 and 35 communicate with the environment through a bag filter 36 such that exhaust air from the cyclones 33 and 35 is discharged to the environment. The cyclones 22, 30, 31, 33 and 35 have, at their respective bottoms, respective air-lock valves 37, 38, 39, 40 and 41. The air-lock valve 37 communicates with a supply port of a powder receiving tank 42 for accumulating the milled material thereinto. The air-lock valves 39, 40 and 41 communicate with a supply port of a powder receiving tank 43 for accumulating the milled material thereinto. Likewise, the air-lock valve 38 communicates with a supply port of a powder receiving tank 44 for accumulating the milled material thereinto.

Figure 2:
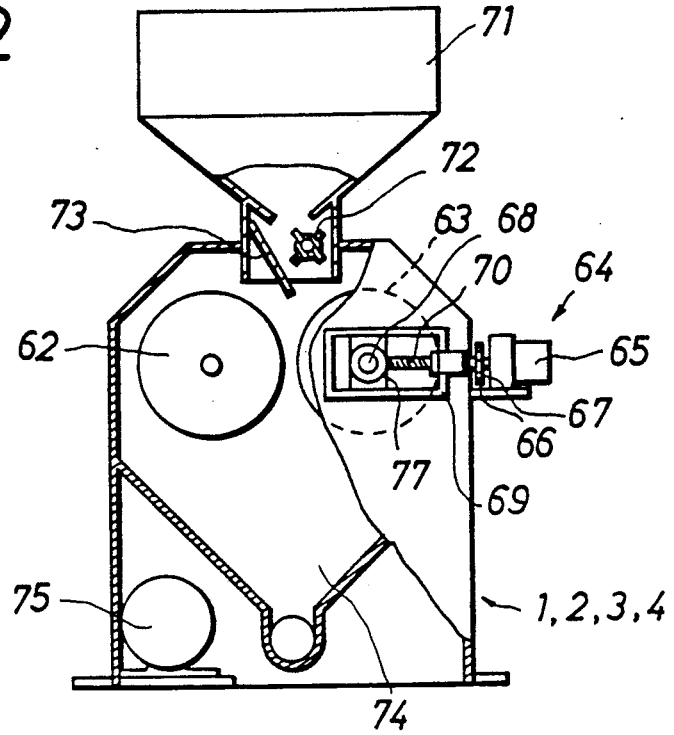
FIG. 2 is a partially broken-away, front elevational view of a roll mill illustrated in FIG. 1.
Figure 3:
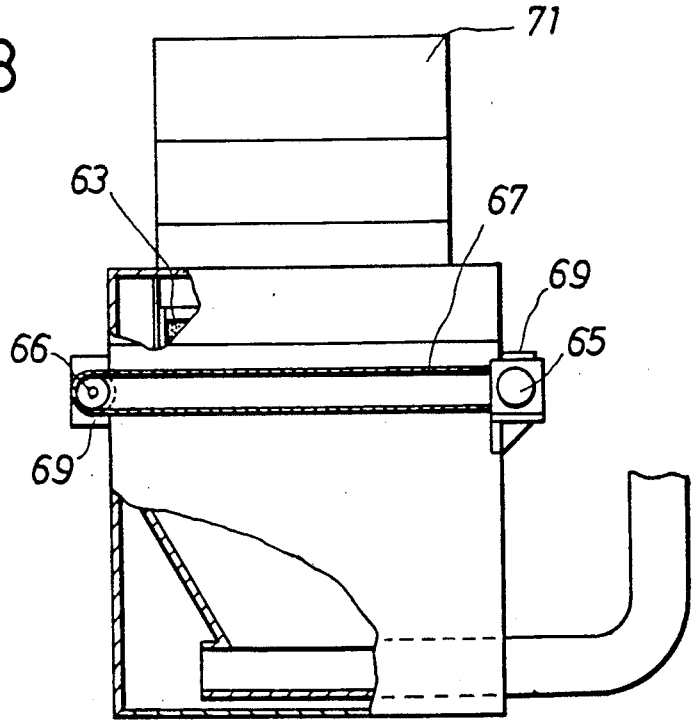
FIG. 3 is a partially broken-away, side elevational view of the roll mill illustrated in FIG. 2.

The first through fourth roll mills 1 through 4 will next be described with reference to FIGS. 2 and 3.

Each of the first through fourth roll mills 1 through 4 comprises a milling chamber within which a pair of rolls 62 and 63 are rotatably arranged in facing relation to each other. One of the rolls 63 is movable toward and away from the other roll 62 so that a gap between the pair of rolls 62 and 63 is adjustable. It is of course that both the pair of rolls 62 and 63 are movable toward and away from each other.

Associated with the roll 63 is a gap adjusting device 64 which comprises drive means or a reversible electric motor 65. Rotation of the reversible motor 65 is converted into reciprocal movement of a pair of adjusting shafts 70 (only one shown) through a pair of sprockets 66 (only one shown) and a chain 67. The adjusting shafts 70 are connected to a shaft 68 for the roll 63 through a pair of blocks 77 (only one shown) which are arranged respectively within a pair of adjusting frames 69 (only one shown) fixedly mounted respectively to both side walls of the roll mill 1, 2, 3 or 4.

Granular material to be milled is supplied to the roll mill 1, 2, 3 or 4 through a supply hopper 71 which is mounted to an upper portion of the roll mill. A feeding roll 72 and a control valve 73, which are arranged at an outlet port of the hopper 71, cooperate with each other to feed an appropriate amount of the granular material.

The milling chamber within the roll mill 1, 2, 3 or 4 has its lower portion which is formed into a discharge chute 74 for pneumatic transportation. The milling chamber has, at its bottom, a main electric motor 75 for rotatively driving the pair of rolls 62 and 63.

In the illustrated embodiment, the gap adjusting device 64 comprises the reversible electric motor 65. However, it is needless to say that, in place of the electric motor 65, cylinders or the like may be utilized which pneumatically or hydraulically control the shaft 68 for the roll 63.

Figure 4:
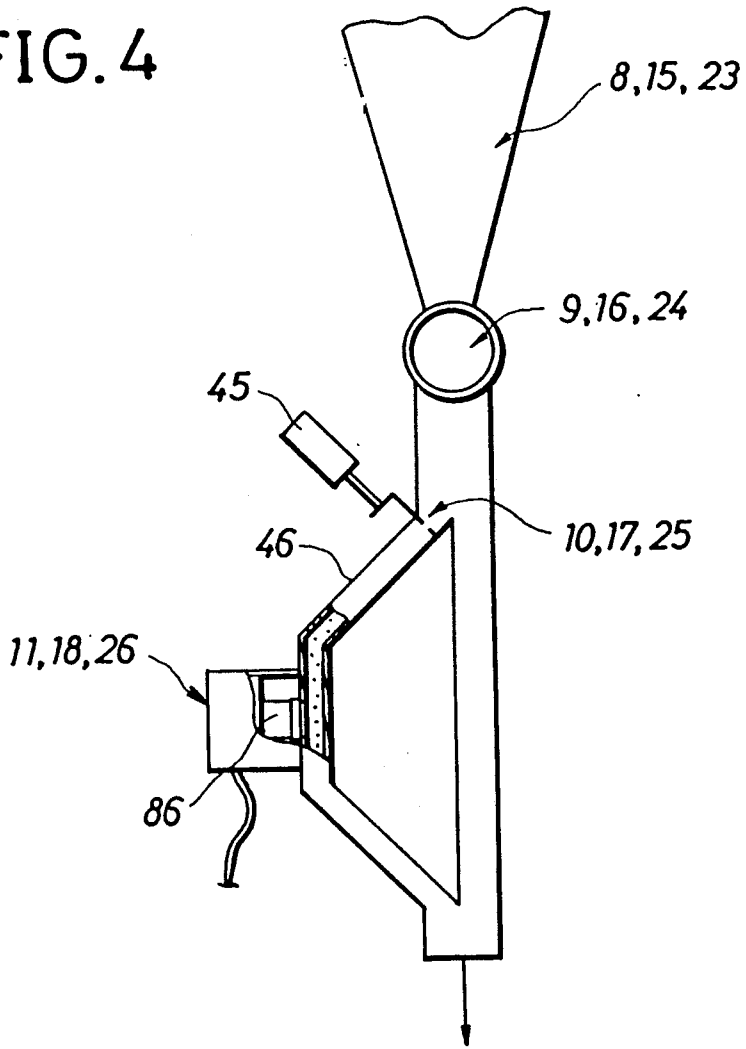
FIG. 4 is a fragmentary side elevational view of a measuring device for measuring a milling degree of milled material, illustrated in FIG. 1.
Figure 5:
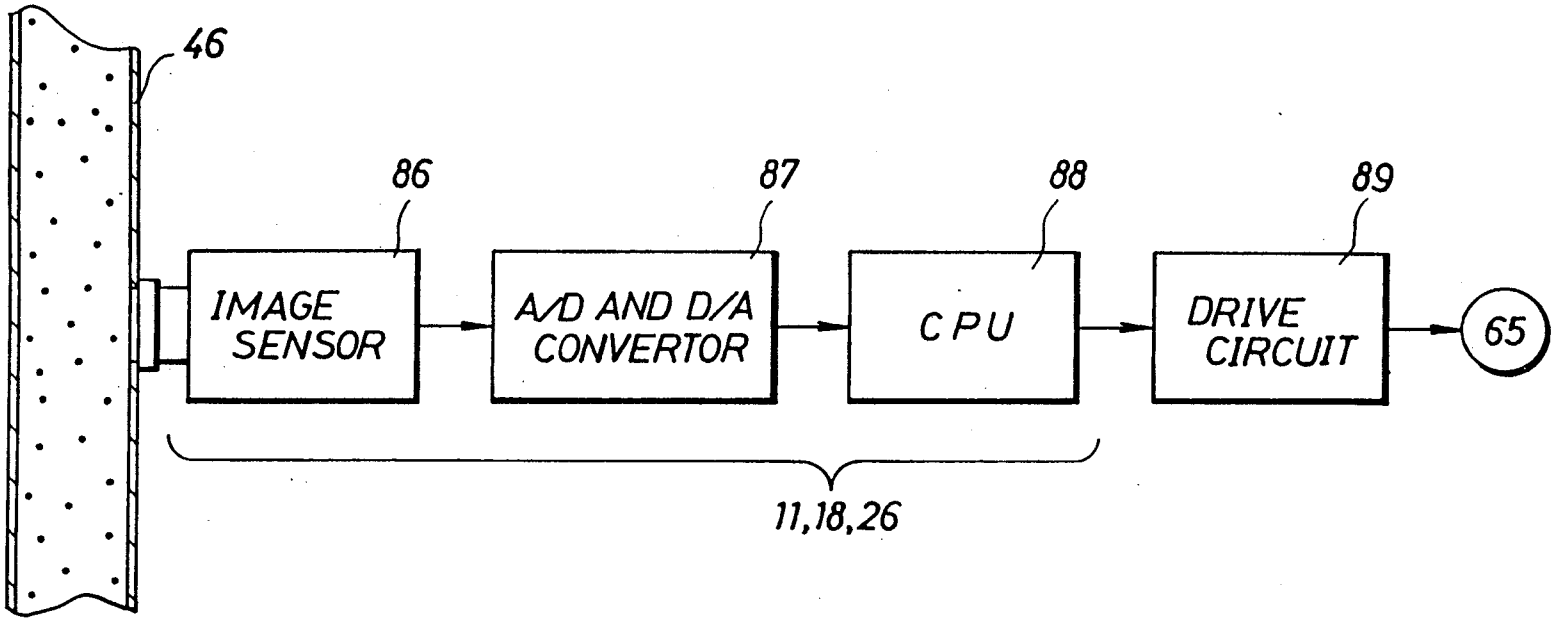
FIG. 5 is a view of the measuring device illustrated in FIG. 4.

The measuring devices 11, 18 and 26 for measuring the milling degrees of the milled material will next be described with reference to FIGS. 4 and 5.

The roll mill 1, 2 or 3 (refer to FIG. 1) has its milled-material discharge port which is connected to the cyclone 8, 15 or 23. The directional control valve 10, 17 or 25 is arranged downstream of the air-lock valve 9, 16 or 24 which is arranged below the cyclone 8, 15 or 23. The directional control valve 10, 17 or 25 is controlled in its opening and closing by an electromagnetic solenoid 45. Milled granular material from the cyclone 8, 15 or 23 passes through a supply duct 46, and is supplied to the measuring device 11, 18 or 26.

The measuring device 11, 18 or 26 comprises picture-signal processing means or an image sensor 86 which is arranged in facing relation to the supply duct 46. The image sensor 86 may be a CCD camera which is provided with a function of high-speed electronic shutter. The image sensor 86 obtains picture signals from the milled material which flow through the supply duct 46, on the basis of projected areas of the milled material. The image sensor 86 catches milled particles under transportation thereof through the supply duct 46, whereby the picture signals of the milled particles are treated as a number of picture elements, by an A/D and D/A converter 87 as illustrated in FIG. 5. The number of picture elements is converted into projected equivalent circles by control means or a central processing unit (CPU) 88, to obtain a particle size of the milled material. The particle size of the milled material is compared with a value which is set beforehand in the CPU 88. The comparison at the CPU 88 generates an output signal which is sent to drive means or a drive circuit 89. An output signal from the drive circuit 89 is sent to the reversible motor 65 of the gap adjusting device 64. The output signal from the drive circuit 89 is also sent to solenoids or the like which drive shutters for the tanks 42, 43 and 44 (refer to FIG. 1).

Figure 6:
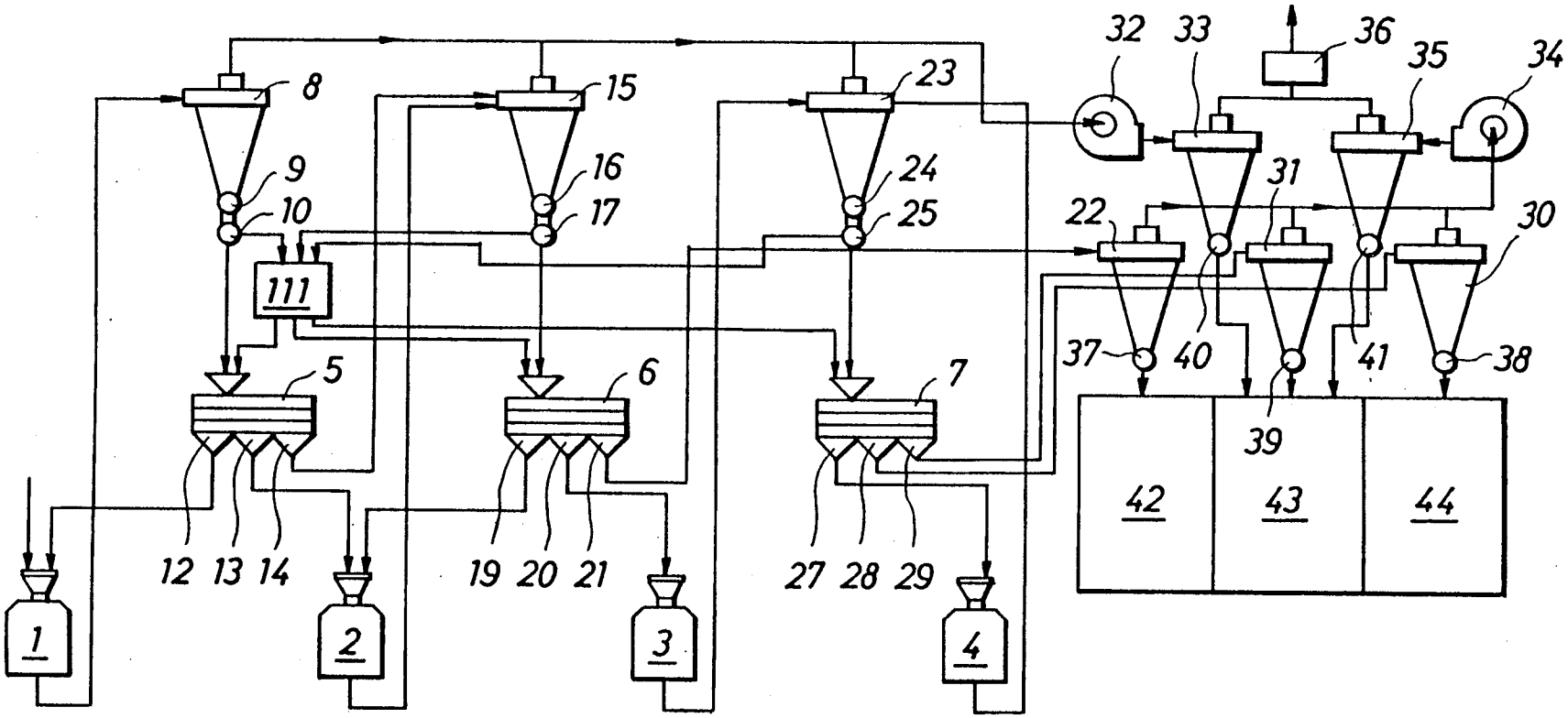
FIG. 6 is a view similar to FIG. 1, but showing a modification of the invention.

In the illustrated embodiment, the measuring devices 11, 18 and 26 are associated respectively with the directional control valves 10, 17 and 25 as well as the sieve sorters 5, 6 and 7. As shown in FIG. 6, however, a single measuring device 111 may be associated with all of the directional control valves 10, 17 and 25 as well as the sieve sorters 5, 6 and 7. Specifically, the measuring device 111 is so arranged as to successively measure the particle sizes of the milled particles which are supplied from the respective cyclones 8, 15 and 23 to the respective sieve sorters 5, 6 and 7. Similarly to each of the measuring devices 11, 18 and 26, the measuring device 111 comprises an image sensor, an A/D and D/A converter, a CPU and a drive circuit. In connection with the above, components and parts like or similar to those illustrated in FIG. 1 are designated by the same reference numerals, and the description of the like or similar components and parts will be omitted to avoid repetition.

The operation of the milling system constructed as above will be described with reference to FIG. 1.

Granular material to be milled such as wheat or the like is first supplied to the first roll mill 1 and is milled thereby to form milled particles. The milled particles are fed to the cyclone 8 by pneumatic transportation. The milled particles from the cyclone 8 are supplied to the sieve sorter 5 through the air-lock valve 9 and the directional control valve 10. The sieve sorter 5 comprises a plurality of sieve screens different in mesh from each other, which are stacked with each other. The sieve screens are oscillated to sort and separate the milled particles into large particles, intermediate particles and small particles which are discharged respectively through the large-particle discharge port 12, the intermediate-particle discharge port 13 and the small-particle discharge port 14. The large particles are returned to the supply hopper of the first roll mill 1. The intermediate particles are fed to the supply hopper of the second roll mill 2. The small particles are supplied to the cyclone 15.

The milled particles supplied to the second roll mill 2 is supplied to the cyclone 15, and are fed to the second sieve sorter 6 through the air-lock valve 16 and the directional control valve 17. The second sieve sorter 6 also sorts and separates the milled particles into large, intermediate and small particles which are discharged respectively through the large-particle discharge port 19, the intermediate-particle discharge port 20 and the small-particle discharge port 21. The large particles are returned to the supply hopper of the second roll mill 2. The intermediate particles are supplied to the supply hopper of the third roll mill 3. The small particles are supplied to the cyclone 22 where the small particles are sorted by air flow and are accumulated into the tank 42 as milled material, through the air-lock valve 37.

The milled particles, which are supplied to the third roll mill 3 and are milled thereby, are supplied to the cyclone 23, and are fed to the third sieve sorter 7 through the air-lock valve 24 and the directional control valve 25. The third sieve sorter 7 also sorts and separates the milled particles into large, intermediate and small particles which are discharged respectively through the large-particle discharge port 27, the intermediate-particle discharge port 28 and the small-particle discharge port 29. The large particles are supplied to the supply hopper of the fourth roll mill 4. The intermediate particles are supplied to the cyclone 30 where the intermediate particles are sorted by air flow and are accumulated as milled material into the tank 44 through the air-lock valve 38. The small particles are supplied to the cyclone 31 where the small particles are sorted by air flow and are accumulated into the tank 43 as milled material, through the air-lock valve 39. Exhaust air from the cyclones 8, 15 and 23 is supplied to the cyclone 33 through the blower 32, and exhaust air from the cyclones 22, 30 and 31 is also supplied, through the blower 34, to the cyclone 35. At the cyclones 33 and 35, the exhaust air is air-sorted and is accumulated into the tank 43 as milled material, through the air-lock valves 40 and 41. The air from the cyclones 33 and 35 is discharged to the environment through the bag filter 36.

The operation of the measuring devices 11, 18 and 26 will next be described with reference to FIGS. 1 and 5.

The milled particles suitably supplied through the supply duct 46 by the directional control valve 10, 17 or 25 are caught by the image sensor 86. The output signal from the image sensor 86 is sent to the A/D and D/A converter 87 where the projected areas of the milled particles are analyzed one by one as the number of picture elements. From the equation in which the number of picture elements $=\pi r^2$, the CPU 88 converts the number of picture elements into the particulate size of one grain. A desirable milling degree or a desirable particulate size is beforehand set in the CPU 88. An amount of distribution or a particulate-degree distribution of the milled particles for various particulate sizes on the basis of the converted particulate sizes of the individual milled particles is compared with a setting value or the aforesaid set milling degree. If the particulate sizes corresponding to a peak of the particulate-degree distribution are larger than the setting value, the milling degree of the milled particles is low. This means that the gap between the pair of rolls 62 and 63 is wide. Accordingly, the CPU 88 issues the output signal to the drive circuit 89 which gives the output signal to the reversible motor 65 such that the gap between the pair of rolls 62 and 63 is narrowed to raise the milling degree. On the other hand, if the particulate sizes corresponding to the peak of the particulate-degree distribution are smaller than the setting value, the milling degree of the milled particles is high. This means that the gap between the pair of rolls 62 and 63 is narrow. Accordingly, the CPU 88 generates the output signal to the drive circuit 89 which gives the output signal to the reversible motor 65 such that the gap between the pair of rolls 62 and 63 is widened to lower the milling degree. Thus, it is possible to operate the roll mills always at their predetermined milling degrees, and to maintain the operation of the roll mills stably.

What is claimed is:

1. An apparatus for milling granular material, comprising:

a roll mill for milling the granular material into milled particles, the roll mill including a pair of rolls which are rotatably arranged in facing relation to each other, at least one of the pair of rolls being movable toward and away from the other, and gap adjusting means associated with said at least one roll for moving said at least one of the pair of rolls toward and away from the other roll to adjust a gap between said pair of rolls thereby adjusting a milling degree of the milled particles; and measuring means for issuing an output signal representative of the milling degree of the milled particles, said measuring means being arranged downstream from said roll mill and connected to said gap adjusting means, and having a picture processing means for measuring projected areas of the milled particles, wherein said gap adjusting means is operative in response to said output signal from said measuring means to move said at least one roll toward and away from the other roll, thereby automatically adjusting the milling degree of the milled particles.

2. An apparatus according to claim 1, wherein said roll mill further includes shaft means for said at least one roll, and drive means associated with said shaft means for driving said shaft means to move said at least one roll toward and away from said other roll.

3. An apparatus according to claim 2, wherein said drive means is a reversible electric motor.

4. An apparatus according to claim 1, wherein said measuring means measures the milling degree of the milled particles based on said projected areas thereof.

5. An apparatus according to claim 4, further comprising duct means through which the milled particles pass from said roll mill, wherein said picture-signal processing means is associated with said duct means for generating picture signals for measurement of the projected areas from the milled particles passing through said duct means, converter means connected to said picture-signal processing means for converting said picture signals into a number of picture elements, control means connected to said converter means, said control means having stored therein a setting value, said control means converting said number of picture elements into a projected equivalent circle to obtain a particulate size of the milled particles, said control means comparing the particulate size with the setting value to generate an output signal, and drive means connected to said control means and to said gap adjusting means, said drive means being operative in response to the output signal from said control means to drive said gap adjusting means.

6. An apparatus according to claim 5, wherein said picture-signal processing means is an image sensor, said converter means is an A/D and D/A converter, and said control means is a central processing unit.

7. A system for milling granular material, comprising:

at least two first and second roll mills for milling the granular material into milled particles, each of said first and second roll mills including a pair of rolls which are rotatably arranged in facing relation to each other, at least one of said pair of rolls being movable toward and away from the other, and gap adjusting means associated with said at least one roll for moving said at least one of the pair of rolls toward and away from the other roll to adjust a gap between said pair of rolls thereby adjusting a milling degree of the milled particles;

at least one measuring means having a picture signal processing means arranged downstream of said first and second roll mills and connected to said gap adjusting means thereof for measuring the milling degree of the milled particles sent from said first and second roll mills, respectively, to issue output signals representative of the milling degrees, said picture signal processing means being for measuring projected areas of the milled particles, wherein said gap adjusting means of each of said first and second roll mills is operative in response to a corresponding one of said output signals from said measuring means to move the at least one roll toward and away from the other roll, thereby automatically adjusting a corresponding one of the milling degrees of the milled particles.

8. A system according to claim 7, wherein each of said first and second roll mills further includes shaft means for the at least one roll, and drive means associated with said shaft means for driving said shaft means to move the at least one roll toward and away from the other roll.

9. A system according to claim 8, wherein each of the drive means of the first and second roll mills is a reversible electric motor.

10. A system according to claim 7, wherein said measuring means measures the milling degree of the milled particles based on said projected areas thereof.

11. A system according to claim 10, further comprising a plurality of duct means through which the milled particles pass from said first and second roll mills, respectively, wherein said measuring means includes picture-signal processing means associated with said plurality of duct means for generating picture signals for the measurement of the projected areas from the milled particles passing through said duct means, converter means connected to said picture-signal processing means for converting said picture signals into a number of picture elements, control means connected to said converter means and having stored therein a plurality of setting values, said control means converting said number of picture elements into projected equivalent circles to obtain particles sizes of milled particles passing through said duct means, said control means comparing particulate sizes of said milled particles from said first and second roll mills with the setting values to generate output signals, and drive means connected to said control means and to said gap adjusting means of the first and second roll mills, said drive means being operative in response to the output signals from said control means to drive said gap adjusting means of the first and second roll mills.

12. A system according to claim 11, wherein said picture-signal processing means is an image sensor, said converter means is an A/D and D/A converter, and said control means is a central processing unit.

13. A system according to claim 7, wherein said measuring means measures the projected areas of the milled particles one by one.

14. A system according to claim 7, further comprising at least two first and second sieve sorters arranged downstream of said measuring means for receiving the milled particles from the first and second mills, wherein each of said first and second sieve sorters has a large-particle discharge port, an intermediate-particle discharge port and a small-particle discharge port, wherein said first sieve sorter has the large-particle discharge port which is connected to said first roll mill, the intermediate-particle discharge port of said first sieve sorter is connected to said second roll mill, the small-particle discharge port of said first sieve sorter is connected to said second sieve sorter through said measuring means, and wherein said second sieve sorter has the large-particle discharge port, the intermediate-particle discharge port and the small-particle discharge port which are connected to the environment.

15. A system according to claim 14, further comprising a plurality of powder receiving tanks connected respectively to the intermediate-particle discharge port and the small-particle discharge port of said second sieve sorter.

16. A system according to claim 15, further comprising a last roll mill being identical in construction to said first and second mills, wherein the large-particle discharge port of said second sieve sorter is connected to said last roll mill.

17. A system according to claim 14, wherein each of said first and second sieve sorters has a plurality of sieve screens arranged in stacked relation to each other.

18. A system according to claim 14, further comprising a plurality of cyclones, said first and second roll mills are connected respectively to said first and second sieve sorters through said cyclones and said measuring means.

19. A system according to claim 18, further comprising a pair of first and second cyclones to which the intermediate-particle discharge port and the small-particle discharge port of said second sieve sorter are connected, and a pair of powder receiving tanks connected to the intermediate-particle discharge port and the small-particle discharge port of said second sieve sorter through said first and second cyclones.

20. A system according to claim 7, including a plurality of measuring means arranged respectively downstream of said first and second roll mills and connected to said gap adjusting means thereof for measuring the milling degrees of the milled particles sent from the first and second roll mills, to issue output signals representative of the milling degrees.

* * * * *